United States Patent [19]

Lindeman

[11] Patent Number: 4,710,133

[45] Date of Patent: Dec. 1, 1987

[54] ELECTRICAL CONNECTORS

[75] Inventor: Richard J. Lindeman, Wood Dale, Ill.

[73] Assignee: TRW Inc., Redondo Beach, Calif.

[21] Appl. No.: 876,179

[22] Filed: Jun. 19, 1986

[51] Int. Cl.[4] ..... H01R 4/66

[52] U.S. Cl. ..... 439/92

[58] Field of Search ..... 339/14 P, 14 R; 439/92

[56] References Cited

U.S. PATENT DOCUMENTS

| | | | |
|---|---|---|---|
| 3,871,728 | 3/1975 | Goodman | 339/14 R |
| 3,922,050 | 11/1975 | Lettini | 339/14 R |
| 3,992,652 | 11/1976 | Blaisdell | 339/14 R X |
| 4,068,910 | 1/1978 | Brown | 335/18 P |
| 4,130,334 | 12/1978 | Anderson | 339/14 R |
| 4,130,934 | 12/1978 | Asick | 339/14 R X |
| 4,179,170 | 12/1979 | Splitt | 339/14 R |
| 4,223,968 | 9/1980 | Kawabata | 339/14 R |
| 4,232,929 | 11/1980 | Zobawa | 339/143 R |
| 4,243,283 | 1/1981 | McSparran | 339/14 R |
| 4,326,764 | 4/1982 | Asick | 339/14 R |
| 4,340,265 | 6/1982 | Ott | 339/14 R |
| 4,358,135 | 11/1982 | Tsuge et al. | 339/14 R X |
| 4,386,814 | 7/1983 | Asick | 339/14 R |
| 4,389,080 | 6/1983 | Clark | 339/14 R |
| 4,395,081 | 7/1983 | Melys | 339/14 R |
| 4,427,247 | 1/1984 | Petersen | 339/14 R |
| 4,451,099 | 5/1984 | Bricker et al. | 339/14 R |
| 4,451,107 | 5/1984 | Dola | 339/14 R X |
| 4,501,459 | 2/1985 | Chandler et al. | 339/143 R X |
| 4,511,196 | 4/1985 | Schuler | 339/14 R |
| 4,516,815 | 5/1985 | Venable | 339/14 R |
| 4,518,209 | 5/1985 | Negley | 339/14 R |
| 4,534,602 | 8/1985 | Bley | 339/14 R |
| 4,550,960 | 11/1985 | Asick | 339/14 R |
| 4,571,012 | 2/1986 | Bassler | 339/14 R |
| 4,571,014 | 2/1986 | Robin | 339/14 R |
| 4,572,600 | 2/1986 | Nieman | 339/14 R |
| 4,582,374 | 4/1986 | Conrad | 339/14 R X |
| 4,582,385 | 4/1986 | Couper | 339/14 R |

FOREIGN PATENT DOCUMENTS

| | | | |
|---|---|---|---|
| 73957 | 3/1983 | European Pat. Off. | 339/143 R |
| 2743406 | 5/1978 | Fed. Rep. of Germany | 339/14 R |
| 143334 | 8/1980 | German Democratic Rep. | 339/14 P |
| 2098412 | 11/1982 | United Kingdom | 339/143 R |

OTHER PUBLICATIONS

"Shielded In-Line Electi Multi Connector", J. Straus, IBM Tech. Disc. Bul., vol. 10, No. 3, Aug. 1967, p. 203.

*Primary Examiner*—William R. Briggs

*Attorney, Agent, or Firm*—Joseph P. Calabrese; Sol L. Goldstein

[57] ABSTRACT

This invention relates to electrical connectors and more particularly to electrical connectors for propagation of a relatively large number of signals between electrical circuits and at very high velocities. The number of signals which can be propagated is quite large in relation to the size of the connectors of the invention and at the same time, the signals can be transmitted at very high velocity and with minimal interference between the signals propagated or from external signal sources. The connectors are also advantageous in that the electrical characteristics of the propagation paths are uniform and they can be readily matched to the characteristics of the circuits which are interconnected so as to minimize standing wave phenomena. The invention also facilitates connection to a plurality of circuit board circuits while providing substantially complete separation of signals propagated to and from the circuits.

16 Claims, 10 Drawing Figures

12

12
22
21
34
32
33
31
22b 14
46
44b
33a
44
45
44a
31a 42b
42
42a 18a
18

ELECTRICAL CONNECTORS

BACKGROUND OF THE INVENTION

Conventional types of connectors have been used heretofore for connection of circuits of mother boards and daughter boards, in computer equipment or in similar applications, and they have generally been highly reliable in operation. However, there have been problems and in the last few years they have been of increasing magnitude, especially when contact spacings are reduced to reduce the sizes of connectors and/or to increase the number of contacts or when the interconnected circuits are designated to use advances in technology which make it possible to transmit large volumes of data at high speeds. Such problems have included loss of transmitted signals, interference between signals or "cross-talk" and interference from extraneous signals. The existence of such increasing problems have been generally recognized but satisfactory solutions have not been apparent.

SUMMARY OF THE INVENTION

This invention was evolved with the general object of providing electrical connectors which will reliably propagate large numbers of signals between circuits at very high velocities while at the same time being of relatively small size and being readily and economically manufactured.

Important aspects of the invention relate to the discovery and recognition of problems with prior connector constructions. It has been found that ground connections tend to develop electrostatic charges when attempts are made to propagate pulse signals at very high speeds as when employing VHSIC or very high speed integrated circuits. A shift in voltage between ground planes of two interconnected circuits may result in loss of reference levels in electronic circuitry, thus rendering computers and the like inoperative. Mismatched impedances between circuitry and connectors causes reflections and the production of undesirable standing wave phenomena, with corresponding errors in transmitting data, in the case of transmitting digital signals. It is also found that cross talk between signal paths increases with frequency and with decreases in the spacing therebetween. This problem is affected to a substantial extent by the characteristics of the ground connection which is common to the two signal propagation paths. Inductances per unit length increase with frequency and if the ground connection has a substantial impedance, it can cause problems with high frequency signal propagation or high velocity pulse signal propagation. This fact has not been generally recognized because the ground paths of conventional connectors have impedances which have not produced a problem when transmitting pulse signals at relatively low velocities, such that transmission of high frequency components is not required.

Typically, one or more connector pins have been used in the past for ground connections and, in some cases, each pin used for signal transmission may have an associated adjacent pin used for a ground connection, in an attempt to minimize cross talk problems. It is found that this does not provide an adequate solution because there may nevertheless be substantial impedances in the ground connections and also, this solution requires many more connector pins. Moreover, if the number of ground pins were increased so as to use two or more pins for each signal pin, it would impose severe space limitations as well as increasing insertion forces.

Another problem with prior constructions relates to the impedance characteristics of the signal paths. Each signal path of an electrical connector may be considered as an electrical transmission line having a certain characteristic impedance determined by the inductance and distributed capacitance per unit length. At relatively low signal transmission velocities, the actual impedance of the path is not usually important. However, at high velocities, the path may produce reflections, resonances and standing wave phenomena when there is a substantial mismatch between the characteristic impedance of the path and the characteristic impedances of the circuits connected thereto. It is also to be observed that it is especially desirable that the characteristic impedances of all paths be substantially the same, so as to facilitate design of the connected circuits.

In an electrical connector assembly constructed in accordance with this invention, a pair of mating connectors are provided, each including a plurality of contact elements and each having a ground plate with electrically insulating material supporting the contact elements and ground plate within an outer shell. The ground plate of each connector has means along one edge thereof for connection to a mating edge portion of the ground plate of the other connector, opposite edges of the ground plates being arranged for connection to circuit means. For example, one connector may be mounted in a mother board and the other connector may be mounted in a daughter board with the ground plate being connected to a ground terminal of a circuit board of the daughter board. In an illustrated embodiment of the invention, the daughter board includes two circuit boards with ground terminals in facing relation engaged with connector means of the ground plate of the connector.

The contact elements of each connector include a group of elements which are supported in a row in longitudinally spaced parallel relation in a first plane with the ground plate being supported in a second plane parallel to the first plane and extending longitudinally for substantially the full length of the row of contact elements. With this arrangement, a sheet ground is provided of very low inductance and resistance which provides a very low impedance and which prevents the build-up of any potential difference between the interconnected circuits. The result is a very substantial increase in the speed and volume of data transmission which can be accommodated in a connector of a given size. The arrangement also minimizes common ground path impedances and cross-talk effects between adjacent signal paths.

In accordance with an important feature of the invention, the contact elements are arranged in groups which are separated by a ground plate, such groups being respectively connected to separate circuit means such as circuits on the opposite side of a printed circuit board or on opposite faces of a pair of separate circuit boards. With this feature, it is possible to obtain substantially complete isolation which is a most important consideration in a great many applications.

Additional important features relate to the attainment of uniform characteristic impedance. The contact elements of each row are preferably at the same distance from the adjacent surface of the ground plate and in an embodiment as illustrated, the shell is provided which is grounded while a second row of contact elements is provided on each side of the ground plate, the distance from the second row to the shell being equal to the distance from the first row to the ground plate with the result being that all contact elements have substantially the same impedance characteristics. In this arrangement, the contact elements may be arranged in staggered relationship and the overall result is a much higher contact density while at the same time minimizing cross-talk and interference from extraneous signals as well as increasing the velocity of signal propagation through the connector.

This invention contemplates other objects, features and advantages which will become more fully apparent from the following detailed description taken in conjunction with the accompanying drawings.

DESCRIPTION OF A PREFERRED EMBODIMENT

Figure 1:
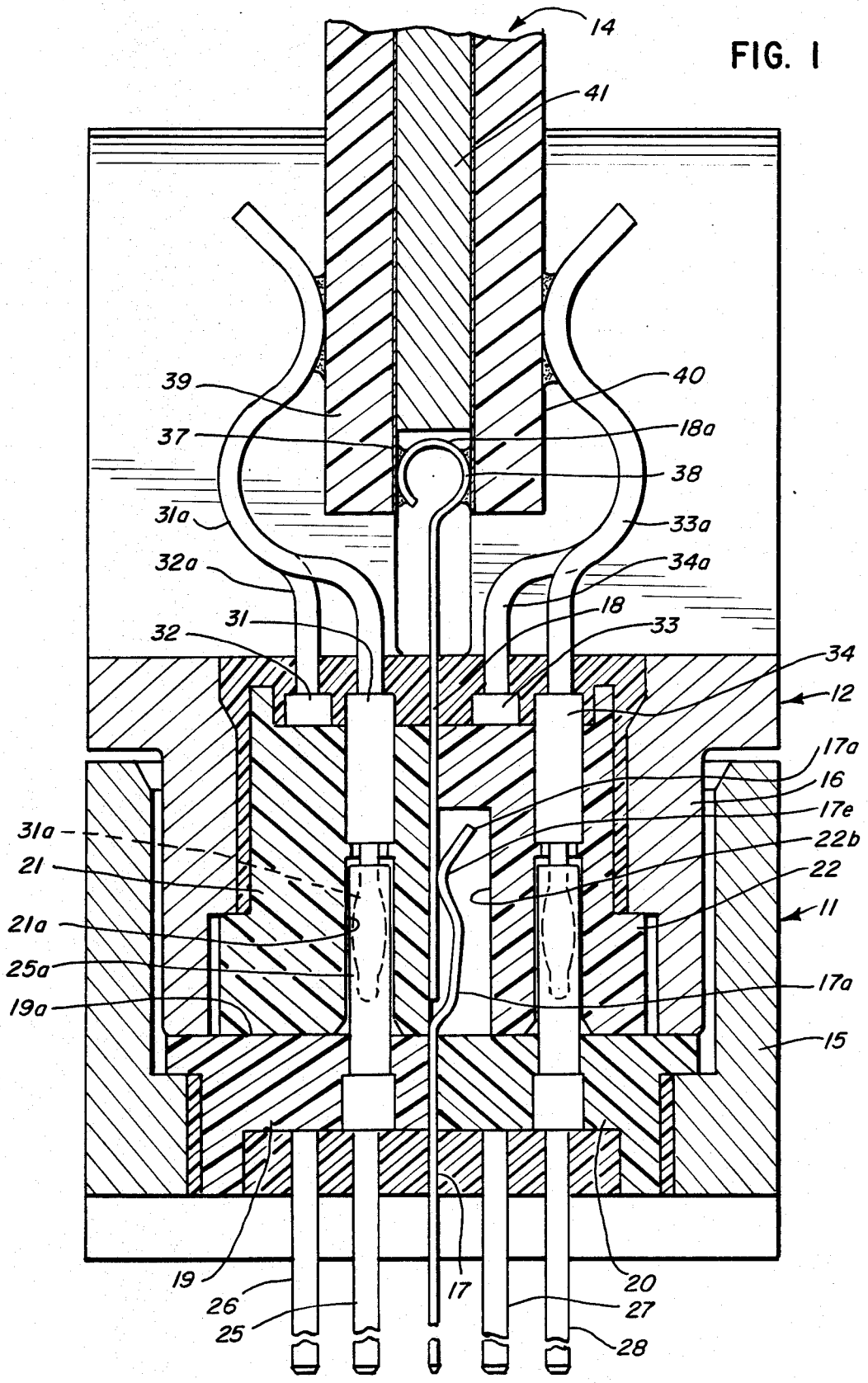
FIG. 1 is a transverse sectional view of a pair of mated connectors constructed in accordance with the principals of this invention, the lower connector of FIG. 1 being a receptacle and the upper connector being a plug and being shown connected to a circuit board assembly.

Reference numeral 10 generally designates a connector assembly constructed in accordance with the principles of this invention. The illustrated assembly 10 includes mating connectors 11 and 12. The connector 11, as shown, is adapted to be mounted on and form part of a mother board and the connector 12 is adapted to receive and to be secured to a circuit board assembly 14 to form a daughter board. It will be understood that the connectors 11 and 12, and the novel features thereof which form part of the invention, may be used in other configurations and for other purposes.

The connector 11 as shown includes an outer shell 15 which receives an outer shell 16 of the connector 12, the connector 11 being thus in the form of a receptacle and the connector 12 being thus in the form of a plug. Shells 15 and 16 are preferably of a highly conductive metal such as aluminum and are preferably connected electrically to each other and to electrical grounds of the interconnected circuits.

In accordance with the invention, the connectors 11 and 12 include central plates 17 and 18 which are connected to the electrical grounds of interconnected circuits and which together define a central planar ground extending along the length of the connector, in a direction normal to the plane of the paper in FIG. 1. They provide a very low impedance ground connection and act as an electrical separation and shield between contacts on opposite sides thereof. Plate 17 is sandwiched between a pair of members 19 and 20 of insulating material which are secured in the shell 15 of connector 11 and plate 18 is sandwiched between a pair of members 21 and 22 of insulating material which are secured within the shell 16 of connector 12.

In the illustrated embodiment, the connector 11 includes contacts in four groups, contacts 25 of the first group being located relatively close to the ground plate 17 and being supported by the member 19, contacts 26 being spaced further from the ground plate 17 and being also supported by the member 19, contacts 27 being supported by the member 20 on the opposite side of the ground plate and relatively close to the ground plate 17 and contacts 28, also supported by the member 20 and being spaced further away from the ground plate 17.

Figure 2:
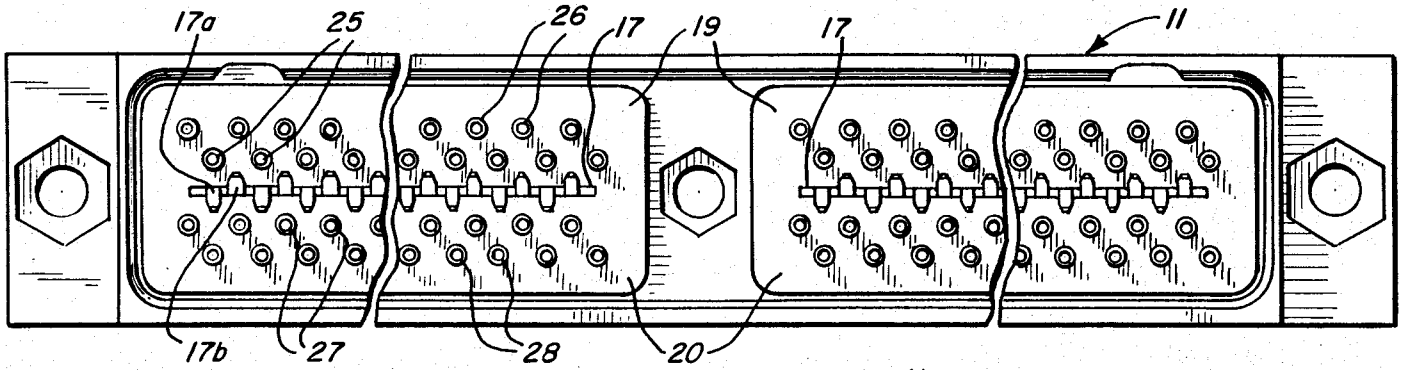
FIG. 2 is a plan view of the receptacle connector of FIG. 1, on a reduced scale and with intermediate portions broken away.
Figure 3:
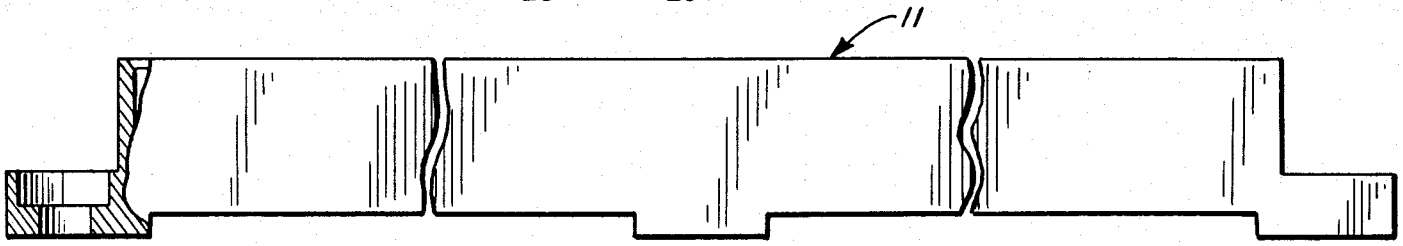
FIG. 3 is a side elevational view of the receptacle connector of FIG. 2.

As shown in FIG. 2, the contacts 25 and 26 are in staggered relationship to each other and the contacts 27 and 28 are similarly in staggered relation to each other. As also shown in FIG. 2, the shell 11 may have an intermediate wall portion 29, separating the connector into two sections with there being two longitudinally spaced ground plates 17 and associated groups of contacts 25–28. Each connector may have a large number of contacts and, by way of example, each section may have 120 contacts with a total of 240 contacts for the two sections, the spacing of contacts as indicated by reference numeral 30 in FIG. 2 being typically 0.075 inches and the overall length of the connector being on the order of 5 inches. With a contact spacing of 0.05 inches, a total of 352 contacts may be provided. It should be understood, of course, that the connectors need not be separated into two sections as illustrated in FIG. 2 and, of course, any appropriate contact spacing may be used. It is, however, an important feature of the invention that a relatively large number of contacts may be provided in a compact connector with relatively close spacing of contacts, while avoiding the problems which would be encountered with such contact spacings when using prior art constructions.

Figures 6, 7, 8, 9, 10:
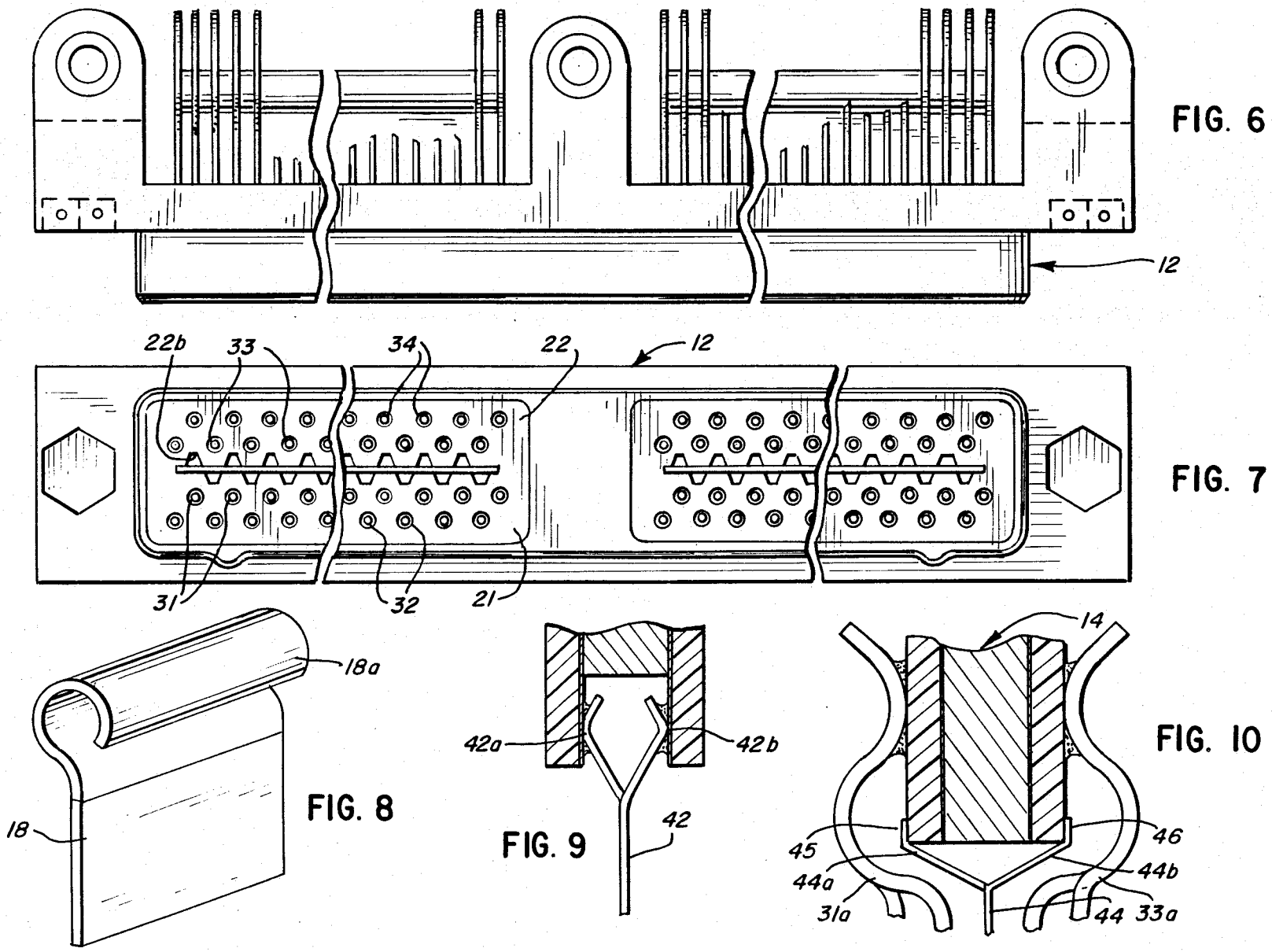
FIG. 6 is a side elevational view of the plug connector of FIG. 1 but on a reduced scale.
FIG. 7 is a plan view of the plug connector as shown in FIG. 6.
FIG. 8 is a fragmentary view of a portion of a ground plate of the plug connector.
FIG. 9 is a view illustrating a modified ground plate for the plug connector.
FIG. 10 is a view illustrating another modified ground plate for the plug connector.

As shown in FIG. 7, the plug connector 12 has contacts 31, 32, 33 and 34 adapted to mate with the contacts 25, 26, 27 and 28, respectively. Contacts 31 and 32 are supported by the insulating member 21 on one side of the ground plate 18 while contacts 33 and 34 are supported by the insulating member 22 on the opposite side of the insulating member.

All contacts have the same spatial relationship to the associated grounded high conductively planar ground plate and shell surfaces so that all signal transmission paths have substantially the same characteristic impedance.

As best shown in FIG. 1, each of the contacts 25 has a hollow end portion 25*a* which projects from a surface 19*a* of the member 19 and which extends into an opening 21*a* in the member 21 to receive a projecting portion 31*a* of the contact 31, indicated in dotted lines. Each of the other contacts of connector 11 has a configuration like that of the contact 25 and each of the other contacts of connector 12 has a configuration like that of the contact 31.

Figure 4:
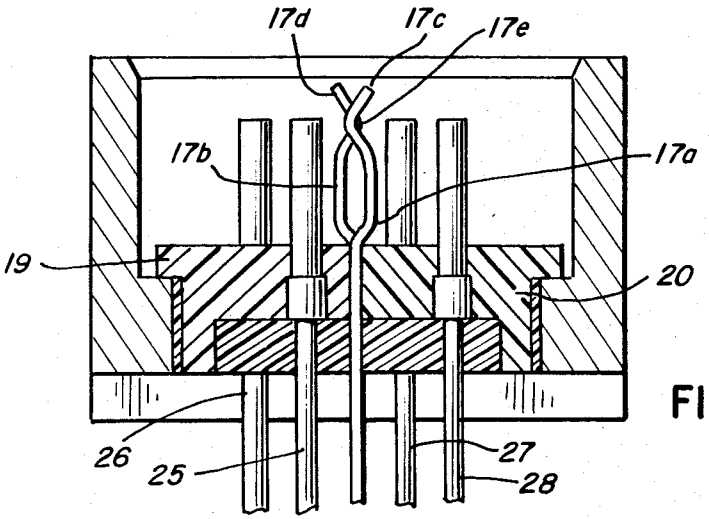
FIG. 4 is a sectional view of the receptacle connector, on a scale larger than that of FIG. 2 but smaller than that of FIG. 1, particularly showing the relationship of engagement fingers or tines of the connector.
Figure 5:
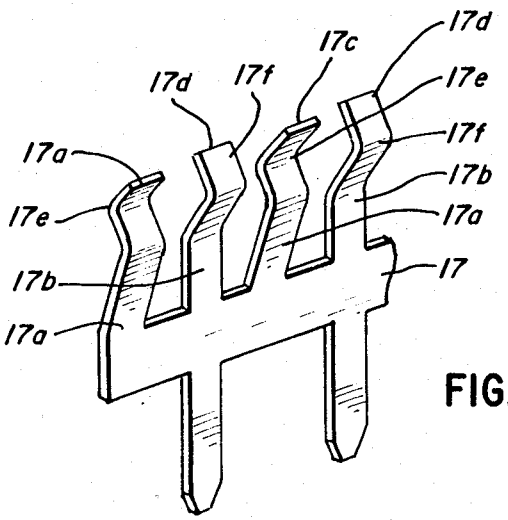
FIG. 5 is a fragmentary perspective view of a ground plate of the receptacle connector.

The construction of the ground plate 17 is illustrated in FIG. 5. It is preferably of a copper alloy which may be approximately 0.006 inch thick with a 0.00005 inch gold plate for maximum conductivity and it is formed with projecting fingers or tines 17*a* and 17*b* as shown, having terminal end portions 17*c* and 17*d* bent in opposite directions from a central plane of the plate 17 and having portions 17*e* and 17*f* for pressure engagement with an edge portion of the plate 18 when the connectors are assembled. The relationship of the tines 17*a* and 17*b* before assembly, is illustrated in FIG. 4. In assembly, the tines 17*a* and 17*b* move into recesses 22*b* and 21*b*, respectively, of the insulating members 22 and 21. In the normal mating sequence, the end of the shell 16 moves into the shell 15, then the edge of the plate 18 moves between the terminal ends 17*c* and 17*d* of the tines 17*a* and 17*b* and then the ends of the contacts 31–34 move into the sockets defined by the hollow ends of the contacts 25–28. With this mating sequence, the ground connection is made before the signal connection and any electrostatic build-up is discharged before engagement of signal contacts. This protects electronic devices from damage during handling and repair.

The construction of the plate 18 is shown in FIGS. 1 and 8. It is preferably of a copper alloy which may be approximately 0.006 inches thick, with a 0.00005 inch gold plate for increased conductivity and, for connection to the circuit board assembly, it has one edge rolled to form an open generally tubular portion 18*a*. The portion 18*a* engages ground terminals which extend in facing relation on the surfaces 37 and 38 of two circuit boards 39 and 40 which form the circuit board assembly 14. In the illustrated arrangement, a thick metal plate 41 is disposed between the circuit boards 39 and 40 to form a heat sink. The circuit boards 39 and 40 are so formed as to provide terminals which engage extensions 31*a*, 32*a*, 33*a* and 34*a* of the contact elements 31, 32, 33 and 34, such extensions extending outwardly and then inwardly and then outwardly, as shown, to provide contact surfaces for contact with terminals on the outwardly facing sides of the circuit boards 39 and 40.

The extensions 31*a*, 32*a*, 33*a* and 34*a* and also the portion 18*a* of ground plate 18 may be tinned before assembly and soldered to the respective terminals after assembly, or other bonding operations may be performed, if desired.

FIG. 9 illustrates a modified ground plate 42 usable in place of the ground plate 18 and having a plurality of fingers or tines along its length, alternate tines 42*a* being bent outwardly in one direction and the remaining tines being bent outwardly in the opposite direction, for engagement with ground terminals of the printed circuit boards 39 and 40.

FIG. 10 shows a modified ground plate 44 which has tines 44*a* and 44*b* formed to engage ground terminals 45 and 46 on the outside surfaces of the printed wiring boards 39 and 40 of assembly 14.

It will be understood that the invention is not limited to use with a dual circuit arrangement as shown. It is advantageous in any application in which providing an adequate ground is a problem and is particularly advantageous in applications in which separation or isolation of circuits is desirable.

It will be understood that modifications and variations may be effected without departing from the spirit and scope of the novel concepts of this invention.

I claim:

1. An electrical connector assembly including a pair of mating connectors and arranged for high velocity propagation of electrical signals along a plurality of paths between first circuit means connected to one connector and second circuit means connected to the other connector, each connector comprising: a plurality of contact elements for propagation of said signals, each having connection means at one end thereof for connection to a terminal of said first circuit means and having a contact surface at an opposite end thereof for engagement with a contact surface of a contact element of the mating connector, a ground plate having connector means along one edge thereof for connection to a ground terminal of said first circuit means and having contact surface means along an opposite edge thereof for engagement with contact surface means of a ground plate of a mating connector, said contact surface means of one connector being in the form of multi-spring-fingered contact surface means along said opposite edge thereof for engagement with oppositely disposed contact surface means of a continuous ground plate of the mating connector, and each connector comprising support means for supporting said contact elements thereof in fixed and electrically insulated relation to each other and to said ground plate thereof, said contact elements of each connector including a group of elements supported in at least one row in longitudinally spaced parallel relation to said ground plate thereof, and said ground plate of each connector extending in a common plane and longitudinally for substantially the full length of said row of contact elements thereof.

2. An electrical connector assembly as defined in claim 1 wherein said contact elements includes a second group of elements supported in a second row parallel to the first row and to said ground plate.

3. An electrical connector assembly as defined in claim 2 wherein said first and second groups of elements are on opposite sides of said ground plate.

4. An electrical connector assembly as defined in claim 2 wherein said first and second groups of elements are on the same side of said ground plate.

5. An electrical connector assembly as defined in claim 1 wherein said support means includes an outer shell of conductive material in generally surrounding relation to said contact elements and said ground plate, and means including insulator means within said shell for support of said contact elements and said ground plate.

6. An electrical connector assembly including a pair of mating connectors for connecting first and second circuit board means, each including ground conductor means and a plurality of terminals insulated from said ground conductor means, each connector comprising: a plurality of contact elements including a group of at least several elements extending longitudinally in spaced parallel relation to form a row of elements in one plane, each of said contact elements of said row having connection means at one end for direct connection to a terminal of one of said circuit board means and having a contact surface at an opposite end for engagement with a contact surface of a contact element of the ating connector, a generally planar ground plate in spaced parallel relation to said plane of said row of elements and extending longitudinally for substantially the full length of said row of elements, said ground plate having ground connection means arranged along the length thereof and along one edge thereof for connection to said ground means of an associated one of said circuit board means and having contact means extending longitudinally along an opposite edge thereof for engagement with contact means extending longitudinally along a similar edge of the ground plate of the mating connector, said ground plates of said connectors being operative when said connectors are mated together to provide a sheet ground which extends in a plane in parallel relation to the plane of the row of contact elements in each connector and from the ground conductor means of one of said circuit board means to the ground conductor means of the other of said circuit board means.

7. An electrical connector assembly including a pair of mating connectors and arranged for high velocity propagation of electrical signals along a plurality of paths between first circuit means connected to one connector and second circuit means connected to the other connector, each connector comprising: a plurality of contact elements for propagation of said signals, each having connection means at one end thereof for connection to a terminal of said first circuit means and having a contact surface at an opposite end thereof for engagement with a contact surface of a contact element of the mating connector, a ground plate having connector means along one edge thereof for connection to a ground terminal of said first circuit means and having a contact surface means along an opposite edge thereof for engagement with contact surface means of a ground plate of a mating connector, and support means for supporting said contact elements in fixed and electrically insulated relation to each other and to said ground plate, said contact elements including a group of elements supported in at least one row in longitudinally spaced parallel relation to said ground plate, said ground plate extending longitudinally for substantially the full length of said rows of contact elements wherein said ground plate of one connector is formed to provide a plurality of spirng fingers along said opposite edge thereof to provide said contact surface means for engagement with contact surface means of a ground plate of a mating connector, wherein said spring fingers are so formed that alternate fingers are engageable with one side of a ground plate of a mating connector and the remaining fingers are engageable with the opposite side of a ground plate of a mating connector.

8. An electrical connector assembly as defined in claim 7 wherein the ends of said fingers are turned outwardly away from the plane of said ground plate to facilitate engagement with a ground plate of a mating connector.

9. An electrical connector assembly as defined in claim 1 wherein each of said first and second circuit means includes a ground terminal and a plurality of ungrounded terminals, said connection means of said ground plates of said connector being arranged for connection to said ground terminals of said first and second circuit means and said connection means of said contact elements being arranged for connection to said ungrounded terminals of said first and second circuit means.

10. An electrical connector assembly as defined in claim 9 wherein at least one of said first and second circuit means includes a plurality of portions, each having a ground terminal and ungrounded terminals, said connections means of said ground plate being engaged with said ground terminals of all of said circuit portions and connection means of said contact elements being connected to ungrounded terminals of said plurality of circuit portions.

11. An electrical connector assembly as defined in claim 9 wherein said ground plate is between certain of said contact elements and the elements connected to said ungrounded terminals of said circuit portions to provide electrical separation and isolation thereof.

12. An electrical connector assembly as defined in claim 10 wherein said ground plate is between certain of said contact elements and the elements connected to said ungrounded terminals of said circuit portions to provide electrical separation and isolation thereof.

13. An electrical connector assembly including a pair of mating connectors and arranged for high velocity propagation of electrical signals along a plurality of paths between first circuit means connected to one connector and second circuit means connected to the other connector, each connector comprising: a plurality of contact elements for propagation of said signal, each having connection means at one end thereof for connection to a terminal of said first circuit means and having a contact surface at an opposite end thereof for engagement with a contact surface of a contact element of the mating connector, a ground plate having connector means along one edge thereof for connection to a ground terminal of said first circuit means and having contact surface means along an opposite edge thereof or engagement with contact surface means of a ground plate of a mating connector, and support means for supporting said contact elements in fixed and electrically insulated relation to each other and to said ground plate, said contact elemens including a group of elements supported in at least one row in longitudinally spaced parallel relation to said ground plate, said ground plate extending longitudinally for substantially the full length of said row of contact elements, wherein said contact elements include a second group of elements supported in a second row parallel to the first row and to said ground plate, wherein said first and second groups of elements are one the same side of said ground plate, and wherein said contact elements include third and fourth groups of elements supported in third and fourth rows on a side of said ground plate opposite said first and second groups, said support means including an outer shell of conductive material in generally surrounding relation to said contact elements and said ground plate, and means including insulator means within said shell for support of said contact elements and said ground plate.

14. An electrical connector assembly as defined in claim 13 wherein said first and second rows and said third and fourth rows are respectively located centrally between said ground plate and said shell to obtain substantially uniform impedance for minimizing reflections, standing waves and cross-talk.

15. An electrical connector assembly as defined in claim 14 wherein the spacings between each of said rows to the adjacent ground plate or shell surface is a small fraction of the length of the conducting path to minimize electromagnetic interference.

16. An electrical connector assembly as defined in claim 1 wherein said ground plate is effective to provide a very highly conductive path for high frequency current components to prevent loss of reference voltage between said first and second circuit means.

* * * * *

UNITED STATES PATENT AND TRADEMARK OFFICE

CERTIFICATE OF CORRECTION

PATENT NO. : 4,710,133

DATED : December 1, 1987

INVENTOR(S) : Richard J. Lindeman

It is certified that error appears in the above-identified patent and that said Letters Patent is hereby corrected as shown below:

Cover page, under "OTHER PUBLICATIONS", "Electi" should read -- Elect." --;

Column 1, line 14, "designated" should read -- designed --;

In the Claims:

Column 6, line 34, "includes" should read -- include --;

Column 6, line 62, "ating" should read -- mating --;

Column 7, line 10, "in" should read -- of --;

Column 7, line 27, delete the "a" at the end of the line;

Column 7, line 39, "spirng" should read -- spring --;

Column 8, line 20, "signal" should read -- signals --;

UNITED STATES PATENT AND TRADEMARK OFFICE

CERTIFICATE OF CORRECTION

PATENT NO. : 4,710,133

DATED : December 1, 1987

INVENTOR(S) : Richard J. Lindeman

It is certified that error appears in the above-identified patent and that said Letters Patent is hereby corrected as shown below:

Column 8, line 28, "or" should read -- for --;

Column 8, line 33, "elemens" should read -- elements --; and

Signed and Sealed this

Sixteenth Day of July, 1991

*Attest:*

*Attesting Officer*

HARRY F. MANBECK, JR.

*Commissioner of Patents and Trademarks*